US008439657B2

(12) United States Patent
Drago

(10) Patent No.: US 8,439,657 B2
(45) Date of Patent: May 14, 2013

(54) CONCRETE PUMP

(76) Inventor: Jambrecina Drago, Lalor Park (AU)

( * ) Notice: Subject to any disclaimer, the term of this patent is extended or adjusted under 35 U.S.C. 154(b) by 165 days.

(21) Appl. No.: 12/740,367

(22) PCT Filed: Nov. 10, 2008

(86) PCT No.: PCT/AU2008/001658

§ 371 (c)(1),
(2), (4) Date: Apr. 29, 2010

(87) PCT Pub. No.: WO2009/059376

PCT Pub. Date: May 14, 2009

(65) Prior Publication Data

US 2010/0260625 A1 Oct. 14, 2010

(30) Foreign Application Priority Data

Nov. 8, 2007 (AU) ..... 2007249107

(51) Int. Cl.
*F04B 39/10* (2006.01)

(52) U.S. Cl.
USPC ..... 417/532; 417/900

(58) Field of Classification Search ..... 417/531, 417/248, 254, 258, 265, 267, 532, 900; 92/169.1; 91/138
See application file for complete search history.

(56) References Cited

U.S. PATENT DOCUMENTS

| | | | | |
|---|---|---|---|---|
| 3,726,614 | A * | 4/1973 | Schellenberg | 417/517 |
| 3,929,400 | A * | 12/1975 | Merton et al. | 417/516 |
| 3,989,420 | A * | 11/1976 | Taylor | 417/517 |
| 4,178,142 | A * | 12/1979 | Schwing | 417/516 |
| 4,533,300 | A * | 8/1985 | Westerlund et al. | 417/339 |
| 5,037,275 | A * | 8/1991 | Schlecht | 417/517 |
| 6,305,916 | B1 * | 10/2001 | Reinert | 417/454 |
| 6,821,097 | B2 * | 11/2004 | Reinert | 417/517 |
| 6,857,861 | B2 * | 2/2005 | Condon et al. | 417/517 |

* cited by examiner

*Primary Examiner* — Devon Kramer

(57) ABSTRACT

A Concrete Pump is a mechanical device comprising of a round funnel shape hoper, pump outlet, rotating pressure and wear plates. Attached to the rotating pressure and wear plates are rotating pump cylinders and opposite the pump cylinders are a rotating wear plate. Pressed against the rotating wear plates is the stationary wear. A hoper outlet and a pump outlet flange are attached to the stationary wear plate. The pump functions as follows: concrete from the hoper passes through the stationary and rotating wear plates into one pump cylinder, at the same time, concrete from another cylinder (previously field with concrete) is pushed through the rotating wear plate and through the stationary wear plate into the pump's outlet. When the pistons reach the end of the cylinders the rotating wear plates and concrete cylinders rotate by 180 degrees and the process is repeated again. The pump is designed so that an entire volume of concrete or similar pumping substance is pumped out of the hoper.

3 Claims, 6 Drawing Sheets

CONCRETE PUMP

BACKGROUND AND SUMMARY OF THE INVENTION

There are many different concrete pumping systems. The most common type is a two cylinder type Piston Pump. Amongst other components, they all have pump cylinders stationed and fastened to the outside back flat wall of the hoper, somewhat above the hoper's floor and aligned inside the hoper thru the same size opening on the hoper forming an alignment inside the hoper with the wear plate, wear ring and swing tube which is situated inside the hoper, thru which concrete is pumped into the pump's outlet, situated on front of pump's hoper. One issue known in the art of concrete pumps is that the equipment has to be cleaned quickly as concrete can set and harden in a short period of time. Further, with more and more cars on the roads and obstacles encountered during concrete deliveries, these deliveries are often delayed and this limits the time a user has to work with the concrete before it starts to set. The following invention is directed toward an improved pumping system to overcome some short falls of existing concrete pumping systems. Existing Pumps cannot pump out the entire contents of concrete delivered into the hoper. This means that every time upon completion of pumping there is a volume of concrete left in the hoper and in the cylinders, usually two wheel barrows and in some cases more. This concrete then has to be removed manually and carted away in buckets or in a wheel barrow, and disposed of as waste. This cleaning process usually takes anything between 30 minutes to 3 hours depending on how much concrete is built-up in the hoper, cylinders and pipe line, and what type (strait pumping or shotcreting) and strength of concrete was pumped and also what the air temperature was during job.

Existing hopers are uneven in shape and have a swing tub in their lower section. Because of this, it is not possible to mix an entire volume of concrete either with a motorized Auger or tools like shovel which is desperately necessary during times when waiting for a concrete delivery truck. Particularly, when the next delivery has been delayed on a hot day it is necessary to add water to the concrete in the hoper and mix it up to stop it from setting hard in the hopper and pumping device. If concrete were to set in the device, a user would be unable to resume pumping upon delivery of the next load and the entire pipe line could be lost, thus preventing the pump from operating and preventing the job from being completed.

In existing concrete pumps, inspection, maintenance or replacement of most wearing parts like, wear plate, wear ring and piston caps, piston's oil seals, swing tub, swing tub's bearing and seal are not easily accomplished because these parts are not easy accessible. Normally this would take anything up to 6 hours, due to fact that very often it is necessary to remove other parts to gain access to the part that you have to inspect or replace.

In many instances it is important for the pump operator to know what slump of concrete is being delivered into the hoper, especially for specialized pumping like shotcreting. At present time no concrete pump known is fitted with such measuring devices, and there is not such a device available for retrofitting.

The problems above are overcome by the present invention.

DESCRIPTION OF THIS INVENTION

Figure 1:
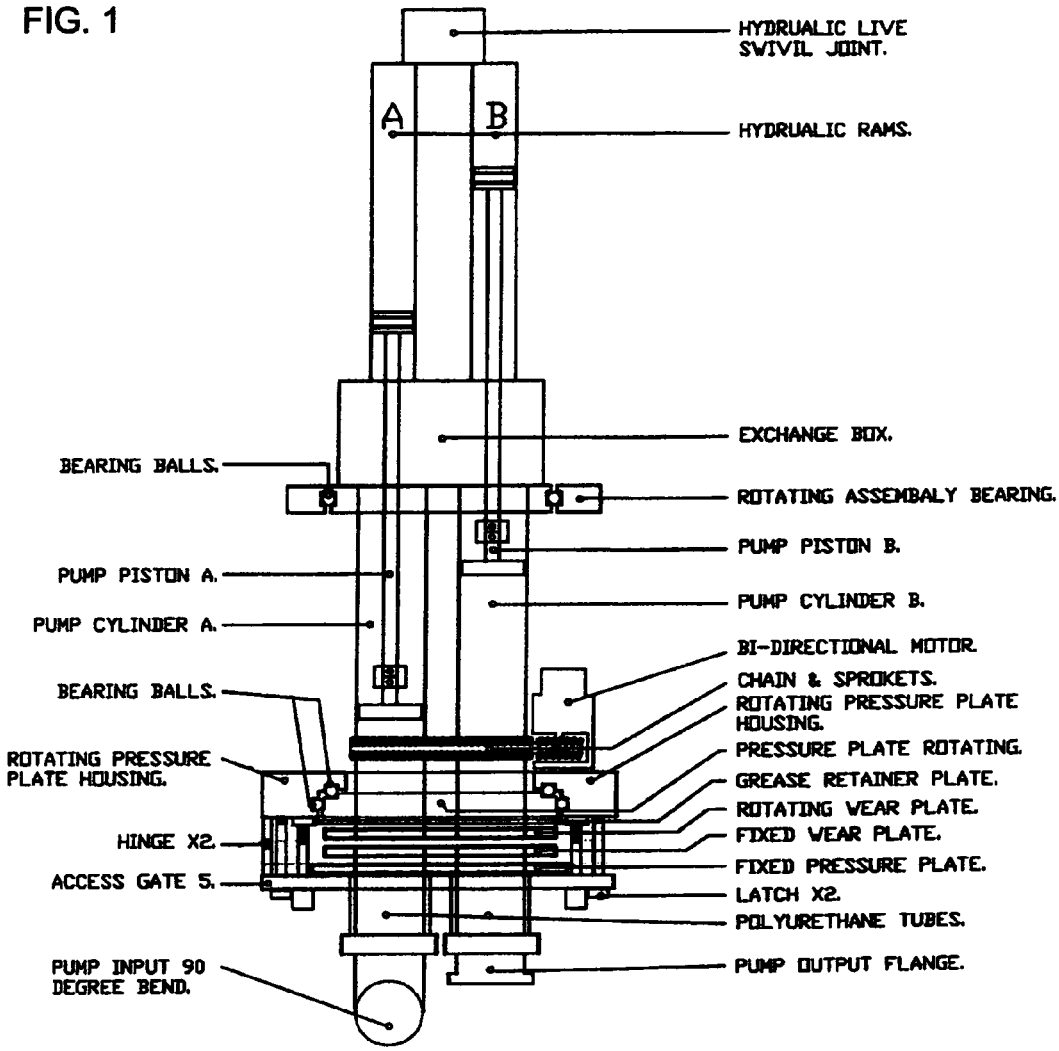
FIG. 1 is longitudinal view of the pumping system of the instant invention.
Figure 2:
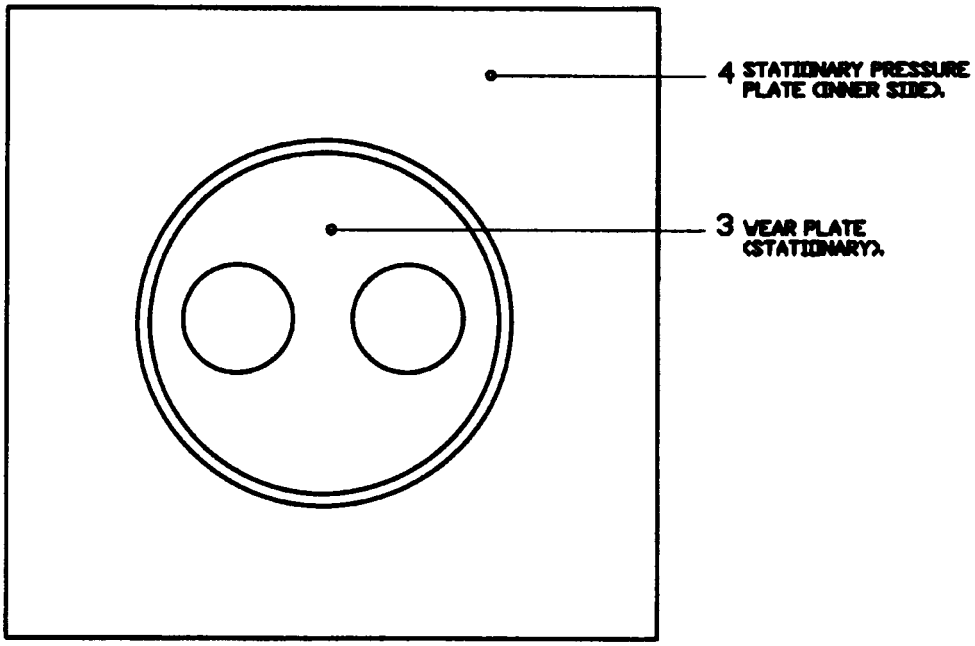
FIG. 2 is an axial view showing the stationary wear plate and the stationary pressure plate.
Figure 3:
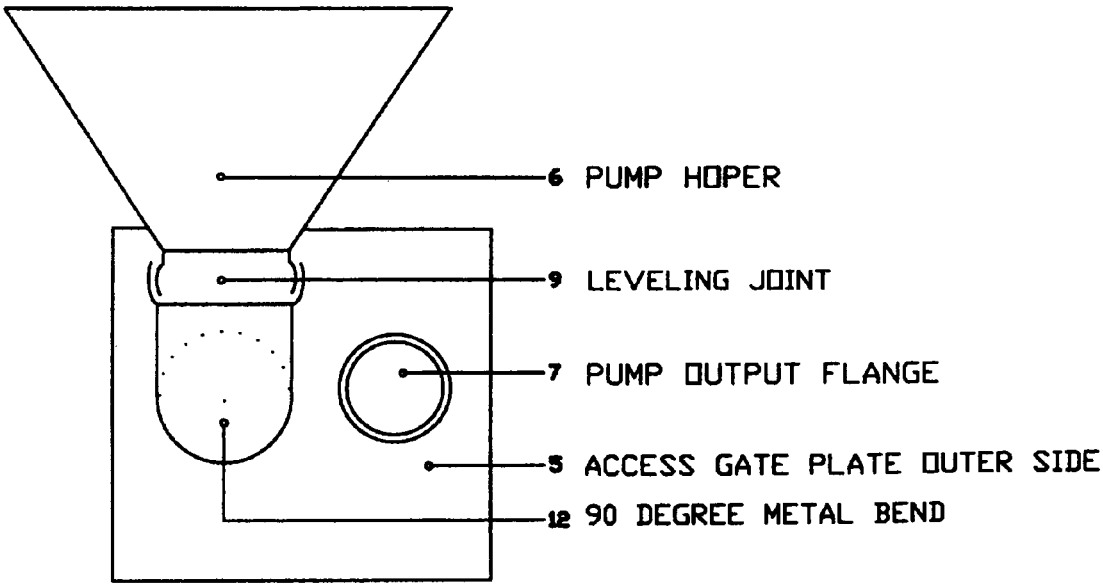
FIG. 3 depicts an end of the pump assembly where the hoper is located and where the pumps outlet is located.
Figure 4:
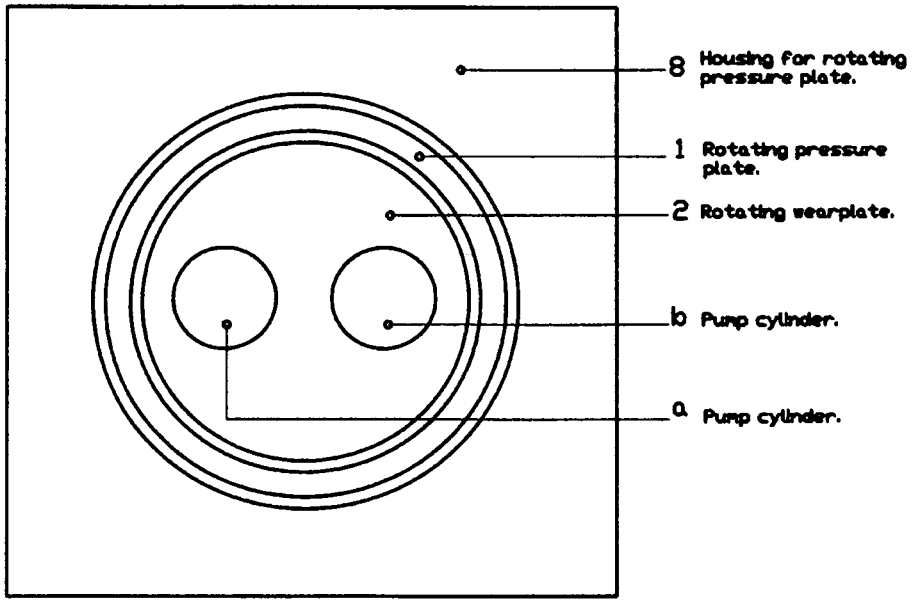
FIG. 4 is an axial view showing the pressure plate and how it is situated in line with the pump cylinder.
Figure 5:
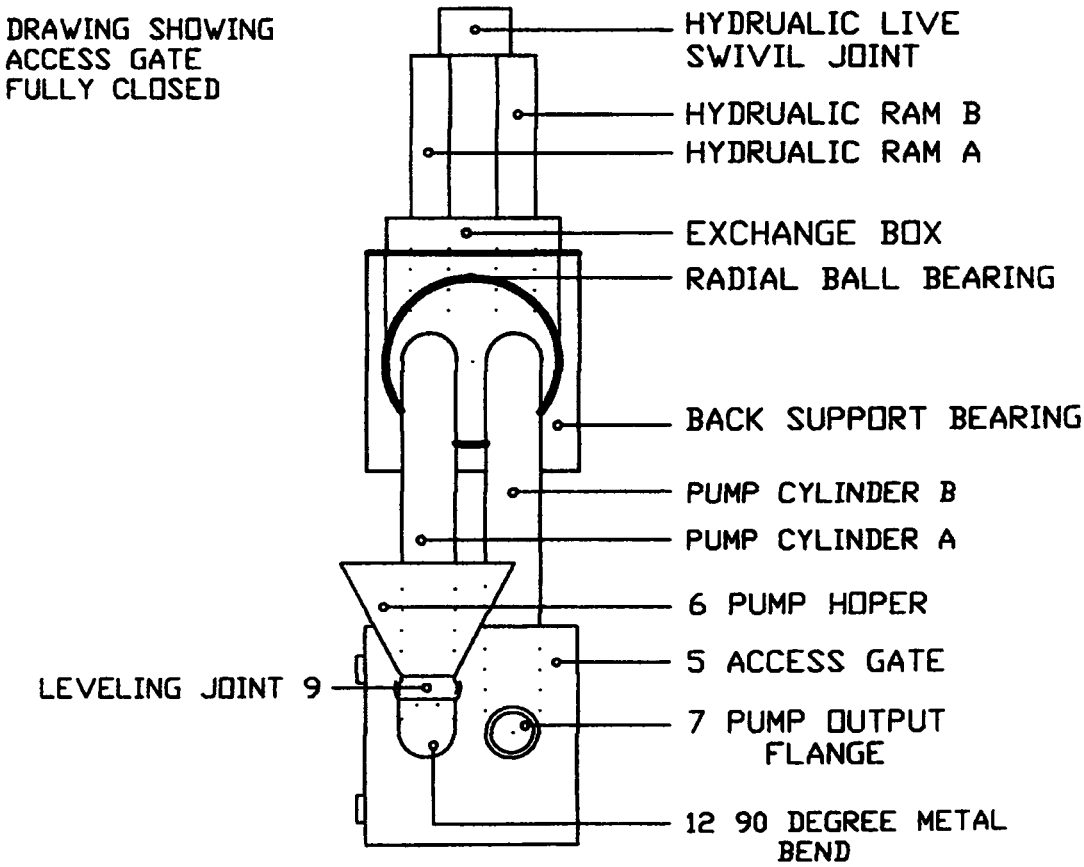
FIG. 5 is a top view of the instant invention depicting the hoper, pump cylinders and hydraulic ram.
Figure 6:
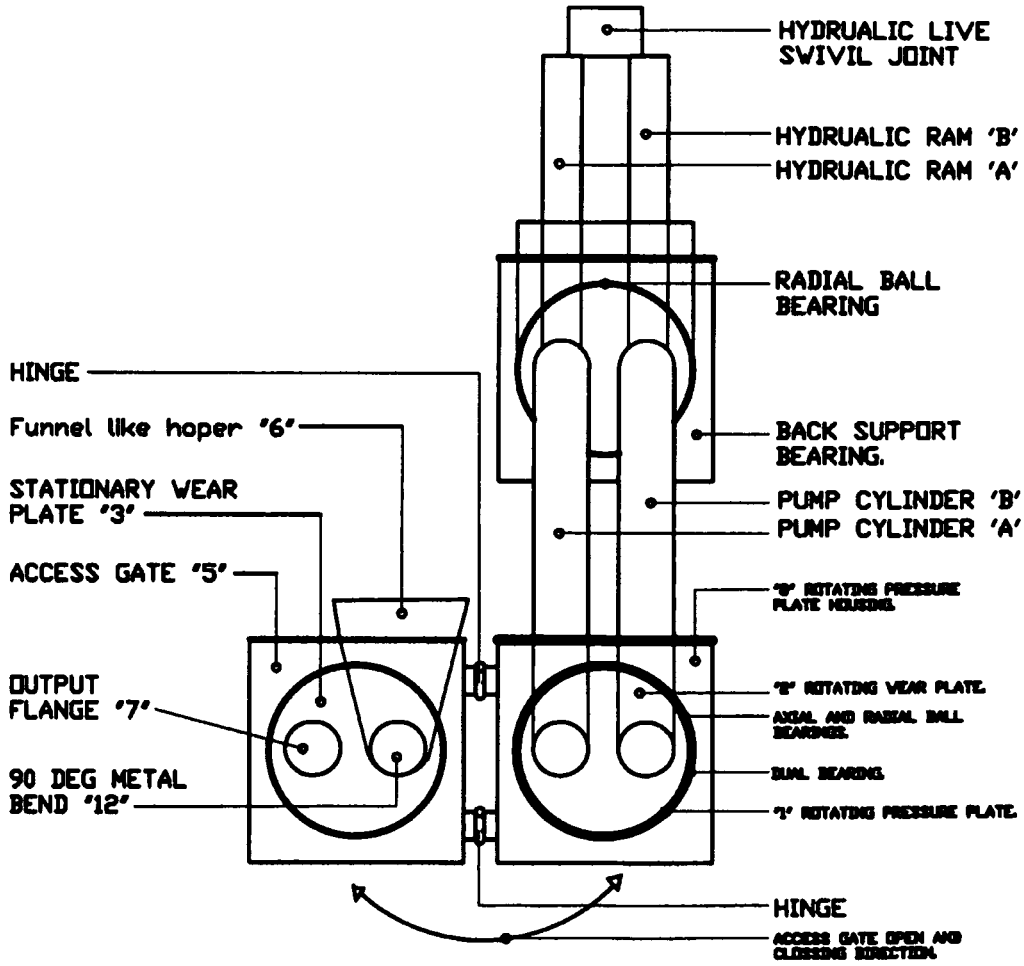
FIG. 6 is a top view of the instant invention showing the access gate open.

The pump of this invention has two rotating pumping cylinders, (cylinder a and cylinder b) a stationary assembly and a funnel like hoper 6. In this design, the pump cylinders are fastened to one side of a rotating pressure plate 1, the other side of the pressure plate is fastened to a rotating wear plate 2. While the other ends of the pump cylinders are fastened to an exchange box, together with a rotating assembly back bearing. The other side of the exchange box is hydraulic cylinders, and the hydraulic cylinders have a hydraulic dual swivel joint fastened thereto. The wear plate, the pressure plate, together with an exchange box and hydraulic cylinders rotate clock wise and anti-clock wise by 180 degrees. The rotating wear plate 2 is pressed and is sliding against a stationary wear plate 3. The stationary wear plate is fastened to a stationary pressure plate 4. The stationary pressure plate 4 is retained on an access gate 5. The stationary pressure plate has one hole (concrete passage between the hoper and the concrete pumping cylinders) connected to the concrete pump hoper 6 on the other side through an access gate via a flexible rubber pipe and further via a 90 degree metal pipe bend and via a flexible joint 9. The stationary pressure plate 4 has another hole (the concrete passage way between concrete pump discharging cylinder and pump's outlet flange) connected to the pump's outlet flange 7 on the other side through the access gate via a flexible rubber pipe. Stationary assembly comprises of; Rotating pressure plate housing, to which is connected access gate 5 via hinges and safety latches. On inner side of access gate 5 is stationary pressure plate, on which is fastened stationary ware plate. On outer side of gate 5 fastened are; pump's output flange and pump input flange. Between pump's input and pump's output flanges and stationary pressure plate, placed are polyurethane pipes. To pump's input flange fastened is 90 degrees metal pipe bend, of which other end facing up and on it is fastened hopper's flexible leveling joint, on top of it is fastened pump's hopper 6. Rotating wear plate is pressed and sliding against stationary wear plate, "3" which is fastened to stationary pressure plate, "4" which is retained on the access gate "5. The access gate 5 is attached to the rotating pressure plate housing 8 with hinges and safety laches. By releasing the safety laches, the access gate together with stationary pressure plate, stationary wear plate, hoper and the pump outlet are able to swing on the hinges away from rotating pressure plate housing as much as 120 degrees. This feature enables inspection or replacement of wear plates, or piston caps and the piston's oil seals.

The hoper is of a funnel shape with an open bottom, and concrete slides down to the bottom of the hoper and through a flexible leveling joint and a 90 degree bend. Within the hoper assembly a removable Auger is installed. An inner side of the hoper is covered by neoprene rubber to provide better sliding of concrete by force of gravity to the bottom of hoper and into pump's cylinders. The hoper is placed on an outer side of the access gate and is connected to the top of the ninety degrees pipe bend via the flexible joint to allow leveling of the hoper when the pump is placed on unleveled ground. Neoprene rubber pipes are used and are vulcanized to metal flanges on each end. The pipes are placed between stationary pressure plate and 90 degrees pipe bend and between stationary pressure plate and pump's outlet. The neoprene rubber pipes have two functions; one is to provide flexible isolation between stationary wear plate and pump's outlet, as well as flexible isolation between stationary wear plate and 90 degrees pipe bend. Another function is to pressure stationary pressure and wear plates against rotating wear plate so to seal and prevent leaking of fluid when the rotating wear plate is rotating. It is beneficial to provide additional pressure on the stationary wear plate only at the time of pumping but not when rotating wear plate is rotating. This minimizes wear of the wear plates. This is achieved by four small hydraulic rams. Rotation of the rotating wear plate, rotating pressure plate and pump cylinders is achieved by placement of steel wire rope around rotating cylinder 11 and attached to the cylinder at a mid-point. Two ends of the rope are attached to two hydraulic rams. One hydraulic ram pulls the rope and rotates the rotating cylinder in one direction by 180 degrees and then when the pistons in pump cylinders reach their destination, the other hydraulic ram pull other end of wire rope in the other direction and rotates rotating cylinder by 180 degrees in other direction. This sequence is repeated as long as pump is in use. The rotation can also be achieved with a bidirectional hydraulic motor using gears. In this case, instead of wire rope attached to the rotating cylinder, a gear or sprocket and chain coupled with bidirectional hydraulic motor is used. Using this method, it is beneficial to rotate rotating assembly in same direction all the time instead alternating in order to counter the inertia of rotating assembly and utilize the beneficial use of gravity. Hydraulic power for hydraulic rams is from electrically controlled hydraulic valves via two hydraulic supply lines to a stationary section of the dual swivel joint, and then two supply lines from a rotating section of the dual swivel joint to the two hydraulic rams.

Timing of rotation of the rotating cylinder depends precisely on the position of the pistons in the pump cylinders. For this reason it is necessary to have some sort of tracking devices to track the pistons within the pump cylinders and start rotation of wear plate and pump cylinders, when piston in pump cylinder reach maximum destination and concrete has been discharged, and in the same time that the other cylinder has being fully charged with concrete from hoper, hydraulic pressure in hydraulic rams which drive pistons in pump cylinder is off. When the 180 degree rotation of the pump cylinders is completed, hydraulic pressure to the hydraulic rams which drive the pistons in pump cylinders is restored, and concrete is flowing again. This sequence is repeated. In this present invention, hall effect transistors detect the positions by use of a magnet, whose movement is same as piston in pump cylinder. The detection signal is than amplified and used for activating solenoids on hydraulic valves.

The pumps sequence is as follows: When the hoper is full of concrete and the pump is switched on, the piston in the charging cylinder will start to trowel away from the hoper and concrete will flow in the cylinder by gravity and suction. When the piston comes to the end, the detection system will switch off piston and will switch on the hydraulic motor which will rotate the rotating assembly by 180 degrees, meaning that pumps full cylinder moves to get in line with the pumps output, and the empty cylinder will become in line with the hoper output. The detection system will switch rotation off and switch pistons on again. The piston with the full cylinder will push concrete out of the pumps outlet and the empty cylinder will become charged with concrete. This process is repeated until pump is switched off.

The benefits of this invention are multiple. 1) Due to the shape and the inside contour of hoper, an entire volume of concrete delivered in hoper, naturally by the force of gravity slides to the bottom of the hoper and into pump cylinder. As a result of this, all of the concrete is pumped out and there is no dry concrete build up in the hoper during the course of a day. This feature enables complete cleaning of the pump, hoper, pistons, cylinders, and pump outlet to take no more than five minutes. 2) The inspection or replacement of fast wearing parts in this invention is very easy and quick, because of the unhindered access and because it consists of only four parts. Two wear plates and two piston caps. The time that is needed to replace all four parts is up to thirty minutes.

The claims that defining invention are as follows:

1. A concrete or sludge pump comprising:

a stationary assembly and a rotating assembly; the stationary assembly comprising: an access gate which is attached to a rotating pressure plate housing by two hinges and two safety latches, the access gate having two large holes disposed on opposite sides of a gate center; when in the closed position, the access gate retains a stationary pressure plate; a stationary wear plate is bolted to the stationary pressure plate; one of the large holes of the access gate is connected to an outlet of the pump, the other of the large holes of the access gate is connected to an inlet of the pump; the pump inlet is connected to a ninety degree upward pipe bend, the other end of the pipe bend connected to a bottom end of upward facing hopper via a flexible leveling joint; the bottom end of the hopper, the end of the other end of the pipe bend, the ninety degree upward pipe bend and pump cylinders all having the same inner diameter;

a neoprene rubber pipe is located between the pump outlet and the stationary pressure plate and a further neoprene pipe is located between the 90 ninety degree pipe bend and the stationary pressure plate; the neoprene rubber pipe having an inner diameter that is the same inner diameter as the pump cylinders; the rotating assembly comprising: a rotating pressure plate housing, a rotating pressure plate; the rotating pressure plate bolted on one side to a rotating wear plate; the other side of the rotating pressure plate bolted to two pump cylinders and a chain sprocket; the pump cylinders are bolted to the rotating pressure plate at one end and the other end of the pump cylinders are bolted to an exchange box; the pump cylinders on one side of the exchange box and the other side of exchange box is bolted to hydraulic rams; each of the two pumping cylinders containing a piston; a piston position electronic detection system is provided for detecting the position of the pistons as they reach their destination; the hydraulic rams bolted to a hydraulic live swivel joint; the hydraulic live swivel joint providing hydraulic pressure from an electrically controlled stationary hydraulic valve to the hydraulic rams to drive the pistons in the pump cylinders; the rotating assembly supported by three ball bearings;

a bi-directional hydraulic motor is bolted to the rotating pressure plate housing; the motor is positioned so that a sprocket on a motor shaft is in line with the sprocket bolted to the rotating pressure plate; a chain links the two sprockets and the motor is able to rotate the rotating assembly 180 degrees per cycle, or continuous about a common axis in both forward or reverse directions.

2. The Pump according to claim 1, wherein the hoper has a round funnel shape with a large round open top and a smaller round open bottom which is used as an output; the total inner surface of the hoper is smooth without any object, parts or mechanism, thus allowing concrete to slide down the wall and through the open bottom out of the hoper into the pump cylinder.

3. The Pump according to claim 1, wherein the two neoprene rubber pipes have two functions; one is to provide a passageway for concrete between 90 degree pipe bend and the stationary pressure plate and to provide flow between the pump output and the stationary pressure plate, and other function is to continue to pressurize the stationary wear plate against the rotating wear plate in order to provide a maximum seal and minimize leakage of concrete slurry between the two, even in the event that the rotating wear plate wobbles.

* * * * *